US005774031A

United States Patent [19]

Linzenich et al.

[11] Patent Number: 5,774,031

[45] Date of Patent: Jun. 30, 1998

[54] LOW-VOLTAGE POWER SWITCH WITH RELATIVE AUXILIARY SWITCH

[75] Inventors: Uwe Linzenich, Simmerath; Andreas Baldewein; Bernd Howald, both of Bonn; Volker Heins, Meckenheim, all of Germany

[73] Assignee: Klöckner-Moeller GmbH, Bonn, Germany

[21] Appl. No.: 687,581

[22] PCT Filed: Jan. 13, 1995

[86] PCT No.: PCT/DE95/00032

§ 371 Date: Aug. 8, 1996

§ 102(e) Date: Aug. 8, 1996

[87] PCT Pub. No.: WO95/22161

PCT Pub. Date: Aug. 17, 1995

[30] Foreign Application Priority Data

Feb. 9, 1994 [DE] Germany ..... 44 04 073.3

[51] Int. Cl.[6] ..... H01H 9/00

[52] U.S. Cl. ..... 335/172; 335/167; 335/20; 335/190; 200/68

[58] Field of Search ..... 335/20, 155, 19, 335/167–172, 185–190; 361/92; 200/61.62, 68, 67 G

[56] References Cited

U.S. PATENT DOCUMENTS 3,599,130 8/1971 Murai .
4,151,386 4/1979 Nicol .
4,321,440 3/1982 Fujiwara et al. .
5,502,426 3/1996 Blanchard et al. ..... 335/132
5,508,670 4/1996 Mantzouridis et al. ..... 335/172

FOREIGN PATENT DOCUMENTS 0199579 10/1986 European Pat. Off. .
2814071 3/1979 Germany .
2814070 4/1979 Germany .
2920775 11/1979 Germany .

*Primary Examiner*—Lincoln Donovan
*Attorney, Agent, or Firm*—Nils H. Ljungman and Associates

[57] ABSTRACT

A low-voltage power switch with a relative auxiliary switch which is actuated as a signalling switch only when the generally multi-pole low-voltage power switch is triggered. The problem to be solved is that of controlling relative auxiliary switches simply and independently of the switch latch. To this end, the switch latch is designed in such a way that the included angle of the moveable contacts or the switching sprindle (18) is greater in the "triggered" than in the "off" state. A radial extension (60) is arranged on the switching spindle (18) in such a way that, in the "triggered" state, it engages a fixed pivoted lever (68) which itself is effectively connected to the prestressed actuating pushrod (66) of the relative auxiliary switch (56).

20 Claims, 2 Drawing Sheets

*Fig.1* ENGAGED
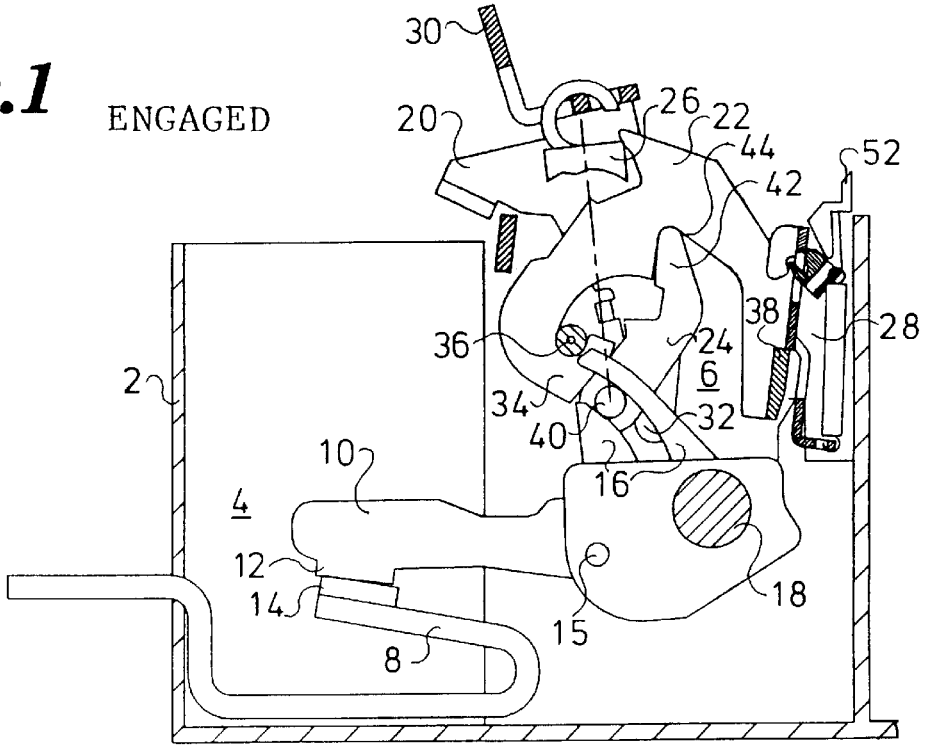
*Fig.2* DISENGAGED
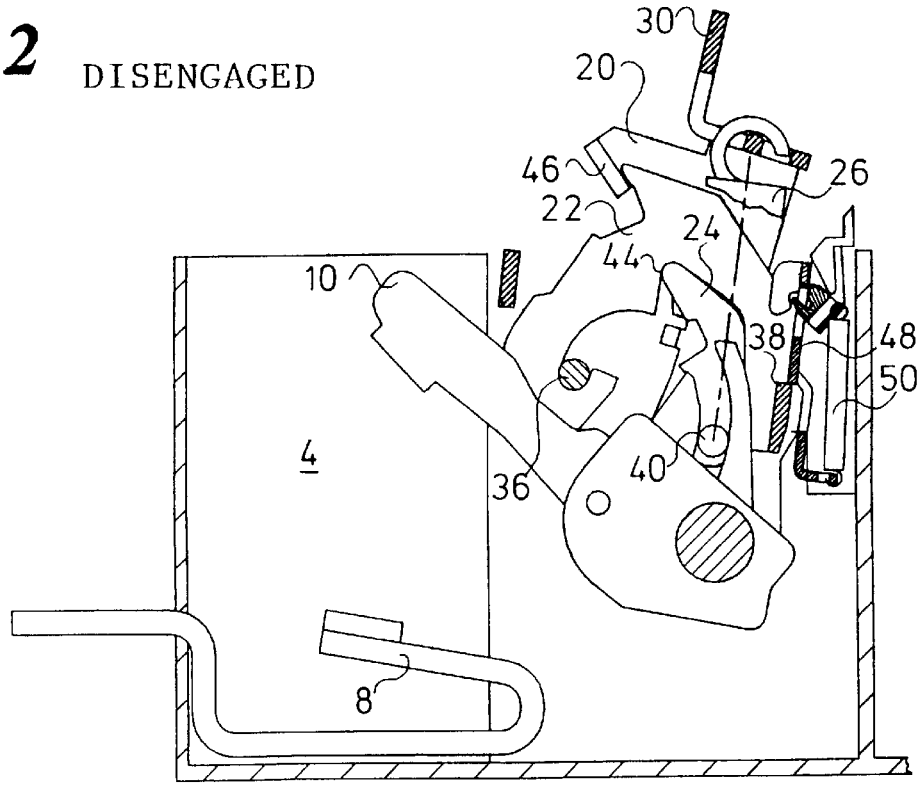

*Fig.3* TRIPPED
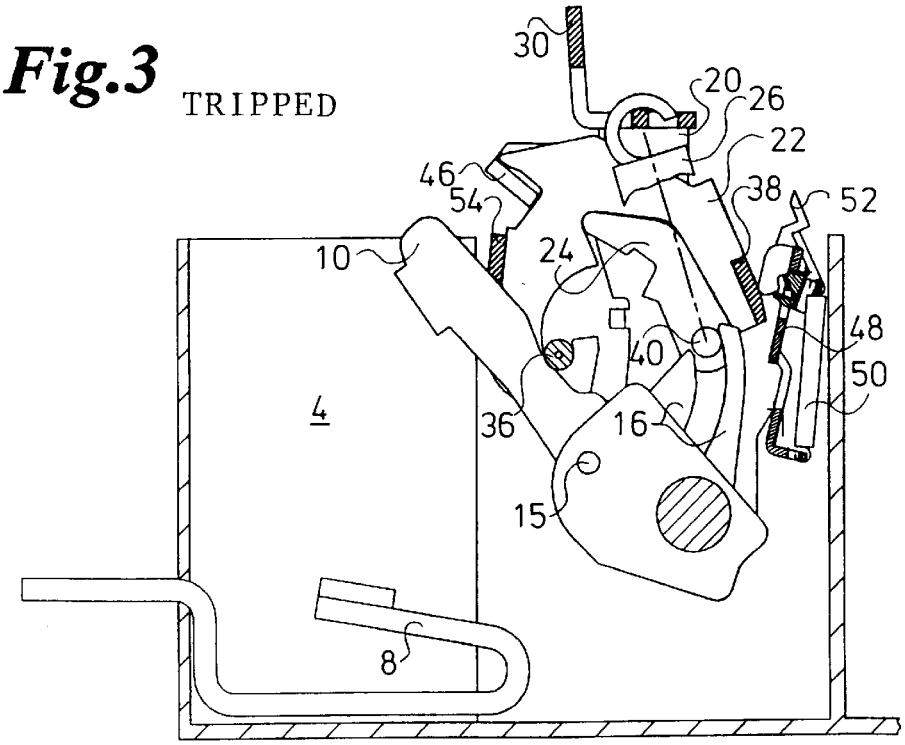
*Fig.4* ENGAGED
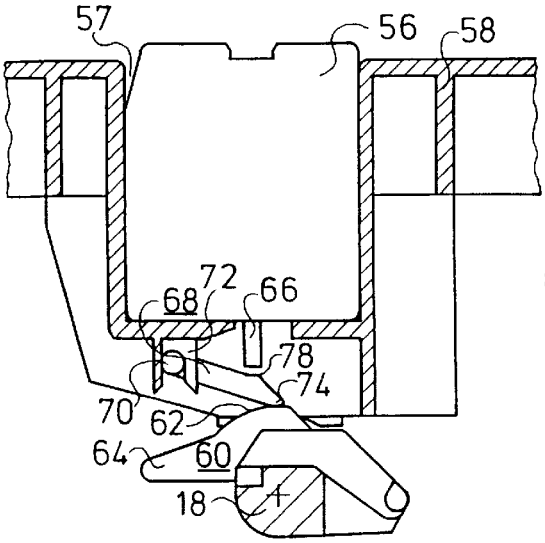
*Fig.5* TRIPPED
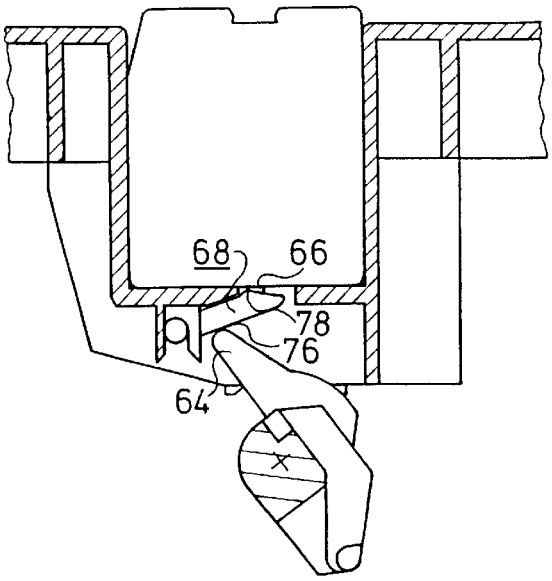

LOW-VOLTAGE POWER SWITCH WITH RELATIVE AUXILIARY SWITCH

TECHNICAL FIELD

This invention relates to a low voltage power switch with relative auxiliary control switch. A relative auxiliary control switch is defined as a pilot switch which is actuated only when the generally multi-pole low voltage power switch is tripped.

PRIOR ART

In DE-B-28 14 070, the relative auxiliary control switch is actuated by of a flexible intermediate element by a driver pin of the latchable support lever of the latching mechanism of the low voltage power switch. In DE-B-28 14 071, the relative auxiliary control switch is actuated by means of a spring-loaded, lever-operated shaft by the support lever of the breaker mechanism.

DE-A-29 20 775 describes a low voltage power switch in which the pre-loaded actuating tappet of a relative auxiliary control switch is also actuated by the support lever by means of a flexible intermediate element. This prior art publication also indicates that the pre-loaded actuating tappet of a normal auxiliary control switch, i.e. of an auxiliary control switch which signals the position of the main contacts, is actuated by means of an additional flexible imtermediate element by a radial extension of the actuating shaft which carries the moving main contacts. This last solution, however, cannot be applied to a relative auxiliary control switch. The disadvantage of the devices of the prior art is that relative auxiliary control switches must be actuated in a complex and complicated manner by the breaker mechanism. Therefore, on multi-pole low voltage power switches, it is impossible to avoid additional and damaging blowout openings between the center pole, which is generally connected to the breaker mechanism, and an outer pole, which generally corresponds to the housing for the relative auxiliary control switch.

The object of the invention is therefore to make possible a simple actuation of the relative auxiliary control switch, which actuation is independent of the breaker mechanism.

DESCRIPTION OF THE INVENTION

The invention teaches that this object can be accomplished by a low voltage power switch with relative auxiliary control switch, with a molded housing in which the relative auxiliary control switch is installed or to which the relative auxiliary control switch is attached, with interacting stationary and moving contacts for each pole, and with an actuating shaft which carries the moving contacts, in which the low voltage power switch has a breaker mechanism which, on one hand, contains a toggle or star actuating means, and on the other hand is linked during opening and closing movements with the moving contacts, and can also be tripped by a tripping means, whereby the opening angle of the moving contacts or of the actuating shaft when the breaker is tripped is greater than in the de-energized state, along with a roller lever which is mounted in the molded housing, which roller lever is linked to a pre-loaded actuating tappet of the relative auxiliary control switch, and finally has a radial extension which is located on the actuating shaft so that this extension acts on the roller lever exclusively in the tripped state.

As a result of the use of the special angular ratios created by the breaker mechanism by means of a single connecting element in the form of the roller lever, a simple interface is created which makes possible a reliable transmission of force between the actuating shaft and the relative auxiliary control switch via a short, dire path. In contrast to similar devices fo the prior art, the complicated actuation of the relative auxiliary control switch by the breaker meachanism by means of complicated lever systems is eliminated. All that is required is a simple plastic part in the form of the roller lever. For multi-pole low voltage power switches, the direct connection path between the actuating shaft and the relative auxiliary control switch also provides improved separation between the breaker mechanism and the space in which for the relative auxiliary control switch is housed, and thus between the individual poles.

DE-A-38 12 950 also describes a breaker mechanism in which cradle elements connected at a distance by means of a cam element open into a cam slot of the actuating shaft and then engage, but with this breaker mechanism of the prior art, it is impossible to achieve an opening angle of the moving contacts which is greater in the tripped state than in the de-energized state.

Additional advantageous embodiments of the invention are described in the subclaims.

In one advantageous embodiment, the breaker mechanism contains a toggle which has a cam element on one end and is supported with the other end of the lever against the force of a spring energy storage element which is engaged between a link connected to the rocker arm and the cam element, and which toggle can be pivoted between the de-energized and the energized state, and can be driven between the tripped state and the de-energized state, against a latchable and unlatchable support lever, whereby the cam element is engaged with at least one cam slot of the actuating shaft, which cam slot is realized so that the tripped state results in an opening angle which is greater than in the de-energized state. It is also advantageous if the curvature of the cam slot bent toward the moving contact is greater than the curvature of the path of movement of the cam element between the tripped and the de-energized state. In contrast to conventional breaker mechanisms with a lower toggle and an upper toggle flexibly connected to the lower toggle, the toggle system in the breaker mechanism claimed by the invention is composed of a cam slot and a toggle which is guided to that it can move rotationally in the cam slot, whereby, in the tripped state, a greater opening angle of the actuating shaft and therefore of the moving contacts can be achieved than in the normal de-energized state. This greater angle is possible in particular on account of a greater curvature of the cam slot with respect to the curvature of the trajectory of the cam element around the axis of rotation of the support lever.

It is appropriate if the toggle system consists of a symmetrical pair of toggles which are connected parallel to one another and held at a distance from one another on one end by means of the cam element which is realized in the form of a connecting shaft. In an additional embodiment, the application area of the roller lever for the extension is closer to the swiveling shaft than the linkage area with the actuating tappet. It thereby becomes possible in a favorable manner to convert the force-intensive and generally small usable rotational movement of the extension into a faster and larger rotational movement of the roller lever. This purpose is also served by the configuration of the extension claimed by the invention, in which the extension has an area for the energized and the de-energized state in the shape of a segment of a circle pointing toeard the free end of the roller lever which makes a transition into an application lever for the tripped state.

In general, the single arm design of the pivoting lever is an advantage, on account of the space thereby saved.

BRIEF DESCRIPTION OF THE DRAWINGS

This invention is explained in greater detail below with reference to the embodiment illustrated in the accompanying drawings, which show additional details and advantages.

FIG. 1: is an illustration, reduced to the essentials, of a low voltage power switch as claimed by the invention, in cross section in the vicinity of the center pole, with a side view of the breaker mechanism, with the switch in the energized state;

FIG. 2: same as above, but in the de-energized state;

FIG. 3: same as above, but in the tripped state;

FIG. 4: is an illustration of the low voltage power switch according to the invention, in cross section in the vicinity of an outer pole with a side view of the relative auxiliary control switch, in the energized state;

FIG. 5: same as above, but in the tripped state.

BEST WAY TO REALIZE THE INVENTION

As illustrated in FIGS. 1 to 3, a contact system 4 and a breaker mechanism 6 are located in the lower part 2 of a molded housing. The contact system 4 comprises of a stationary contact 8 and a moving contact 10, the moving contact piece 12 of which can be brought into and out of contact with a stationary contact piece 14 of the stationary contact 8. The moving contact 10 is mounted in an actuating shaft 18 which lies crossways so that it can pivot around an axis 15, and is connected to the breaker mechanism 6 by means of the cam slot 16 molded onto the actuating shaft 18.

The breaker mechanism 6 comprises a link 20, a support lever 22, a toggle 24, a spring energy storage device 26 and a latching mechanism 28. The link 20 on one hand has a rocker arm 30 which is to be actuated, and on the other hand is supported by means of its leg end 32 so that in can pivot in the lower part 2. The support lever 22 is supported on one hand by means of an encompassing engagement 34 on a stationary horizontal axis 36, and on the other hand can be latched by means of its latching surface 38 with the latching mechanism 28. The toggle 24 on one hand is movably guided by means of a cam element 40 in the cam slot 16, and on the other hand is supported with its lever end 42 against the force of the spring energy store 26, which is engaged between the toggle-side end of the link 20 and the cam element 40, so that it can pivot against an abutment 44 on the support lever 22.

When the rocker arm 30 pivots clockwise from the tripped state into the de-energized state, the support lever 22 is driven by a driver element 46 of the link 20, also clockwise, and is latched on its latching surface 38 by a latch 48 of the latching mechanism 28, to which pressure is applied by a latch spring 50 in a manner known to the prior art. As the rocker arm 30 pivots counterclockwise from the de-energized state toward the energized state, the upper engagement point of the spring energy storage device 26 is also pivoted counterclockwise, so that after passing the overstretched position of the spring energy storage device 26, the toggle rolls clockwise in the abutment 44, as a result of which the contact system 4 is closed by means of the cam element 40 and the cam slot 16. As the toggle 30 pivots clockwise from the energized state toward the de-energized state, the toggle 24 rolls in an analogous manner in the counterclockwise direction, whereupon the contact system 4 is opened. When the system parameters are above or below the specified operating conditions, a tripping system (not shown) actuates a trip lever 52 of the latching mechanism 28 in the counterclockwise direction, as a result of which the latching surface 38 is released by the latch 48, and by means of the thereby unlatched support lever 22, the breaker mechanism 6 breaks down under the action of the spring energy storage device 26. The support lever 22 thereby pivots in the counterclockwise direction—limited by a stationary stop element 54—into the tripped state, and the contact system 4 is opened by means of the cam element 40 of the toggle 24 which rolls in the clockwise direction, due to the cam slot 16.

As shown by a comparison of FIGS. 2 and 3, the contact system 4 assumes a larger opening angle between the moving contact 10 and the stationary contact 8 in the tripe state than in the de-energized state. This is achieved because the cam element 40 is rotationally connected to the cam slot 16, and the curvature of the path of movement of the cam element 40 which occurs during the transition into the tripped state is smaller than the curvature of the cam slot 16 bent around the axis 15.

FIGS. 4 and 5 illustrate the interaction of the actuating shaft 18 described above with a relative auxiliary control switch 56 which is fastened in a suitable manner in a recess 57 provided for the purpose in the upper portion 58 of the molded housing. Molded onto the actuating shaft 18 is a radial extension 60. The extension 60 consists of an area 62 which is in the shape of a segment of a circle, and makes a transition on one side into an application lever 64 which points away from the actuating shaft 18. Between an actuating tappet 66 of the relative auxiliary control switch 56 which points toward the actuating shaft and the extension 60, there is a one-armed roller lever 68, the rotation shaft 70 of which is mounted in a lever bearing 72 which is connected to the upper part 58.

The actuating tappet 66 is spring-loaded in the conventional manner in a direction which points outward from the auxiliary control switch 56, so that when the low voltage power switch is in the energized state, as shown in FIG. 4, the roller lever 68 is in contact with its free end 74 on the area 62 in the shape of a segment of a circle on the extension 60. When the low voltage power switch makes the transition from the energized into the de-energized state, i.e. when the actuating shaft 18 rotates clockwise, the free end 74 of the pivoting lever 68 slides on the periphery of the area 62 in the shape of a segment of a circle on the extension 60, so that no pivoting movement of the roller lever 68 can take place. But if the low voltage power switch switches into the tripped state, and the actuating shaft 18 thereby rotates clockwise farther than in the de-energized state, the free end 74 moves beyond the range of the area 62 which is in the shape of a segment of a circle. Instead, in the manner illustrated in FIG. 5, the pivoting lever 68 is pushed in the counterclockwise direction by means of its application area 76 which is close to the pivoting axis by the application lever 64. As a result, the actuating tappet 66 is applied to the end surface by a hump-shaped linkage area 78 of the roller lever 68, which area is farther from the axis of rotation inside the relative auxiliary control switch 56, as a result of which the relative auxiliary control switch is actuated and a corresponding alarm signal is emitted from its line connections (not shown) which signals the tripped state. As a result of the ratio of the distances of the pressurization area 76 and of the linkage area 78 to the shaft 70, the relatively s difference in the angular position of the actuating shaft 18 between the de-energized and the tripped state is advantageously converted into a sufficiently large stroke movement of the actuating tappet 66.

We claim:

1. Low voltage power breaker with relative auxiliary control switch, comprising a molded housing, in or on which the relative auxiliary control switch is mounted or attached, interacting stationary and moving contacts for each pole, as well as an actuating shaft which carries the moving contacts, said low voltage power breaker comprising:

a breaker mechanism which on one hand comprises a rocker arm or similar actuation means, and on the other hand is linked during opening and closing with the moving contacts, the breaker mechanism comprises a latching mechanism with a trip lever being engagable with a latch spring and can be tripped by tripping means, whereby the opening angle of the moving contacts and of the actuating shaft in the tripped state is greater than in the de-energized state;

a roller lever mounted in the molded housing, which is linked to a pre-loaded actuating tappet of the relative auxiliary control switch; and a radial extension which is located on the actuating shaft, so that this extension applies pressure to the pivoting lever exclusively in the tripped state.

2. Low voltage power breaker as claimed in claim 1, wherein the breaker mechanism has a toggle which has a cam element on one end, and is supported with the other lever end against the action of a spring energy storage device which is engaged between a link connected to the rocker arm and the cam element, and which toggle can be pivoted between the de-energized and the energized state, and can be driven between the tripped and the de-energized state against a latchable and unlatchable support lever;

the cam element is engaged with at least one cam slot of the actuating shaft, which cam slot is realized so that the tripped state results in a larger opening angle than in the de-energized state.

3. Low voltage power breaker as claimed in claim 2, wherein the curvature of the cam slot bent toward the moving contact is greater than the curvature of the path of the cam element between the tripped and the de-energized state.

4. Low voltage power breaker as claimed in claim 2, wherein the toggle system comprises a symmetrical pair of toggles which are connected parallel to one another and held at a distance from one another on one end by means of the cam element which is realized in the form of a connecting shaft.

5. Low voltage power breaker as claimed in claim 4, wherein the application area of the pivoting lever for the extension is closer to the swivel pin than the linkage area with the actuating tappet.

6. Low voltage power breaker as claimed in claim 4, wherein the extension has an area in the form of a segment of a circle which points toward the free end of the pivoting lever for the energized and de-energized state, and which makes a transition into an application lever for the tripped state.

7. Low voltage power breaker as claimed in claim 4, wherein the roller lever comprises a single arm.

8. Low voltage power breaker as claimed in claim 1, wherein the application area of the pivoting lever for the extension is closer to the swivel pin than the linkage area with the actuating tappet.

9. Low voltage power breaker as claimed in claim 2, wherein the application area of the pivoting lever for the extension is closer to the swivel pin than the linkage area with the actuating tappet.

10. Low voltage power breaker as claimed in claim 3, wherein the application area the pivoting lever for the extension is closer to the swivel pin than the linkage area with the actuating tappet.

11. Low voltage power breaker as claimed in claim 1, wherein the extension has an area in the form of a segment of a circle which points toward the free end of the pivoting lever for the energized and de-energized state, and which makes a transition into an application lever for the tripped state.

12. Low voltage power breaker as claimed in claim 2, wherein the extension has an area in the form of a segment of a circle which points toward the free end of the pivoting lever for the energized and de-energized state, and which makes a transition into an application lever for the tripped state.

13. Low voltage power breaker as claimed in claim 3, wherein the extension has an area in the form of a segment of a circle which points toward the free end of the pivoting lever for the energized and de-energized state, and which makes a transition into an application lever for the tripped state.

14. Low voltage power breaker as claimed in claim 1, wherein the roller lever comprises a single arm.

15. Low voltage power breaker as claimed in claim 2, wherein the roller lever comprises a single arm.

16. Low voltage power breaker as claimed in claim 3, wherein the roller lever comprises a single arm.

17. Low voltage power breaker as claimed in claim 1, wherein the toggle system comprises a symmetrical pair of toggles which are connected parallel to one another and held at a distance from one another on one end by means of the cam element which is realized in the form of a connecting shaft.

18. Low voltage power breaker as claimed in claim 5, wherein the extension has an area in the form of a segment of a circle which points toward the free end of the pivoting lever for the energized and de-energized state, and which makes a transition into an application lever for the tripped state.

19. Low voltage power breaker as claimed in claim 18, wherein the roller lever comprises a single arm.

20. Low voltage power breaker as claimed in claim 3, wherein the toggle system comprises a symmetrical pair of toggles which are connected parallel to one another and held at a distance from one another on one end by means of the cam element which is realized in the form of a connecting shaft.

* * * * *

UNITED STATES PATENT AND TRADEMARK OFFICE

CERTIFICATE OF CORRECTION

PATENT NO. : 5,774,031

DATED : June 30, 1998

INVENTOR(S) : Uwe LINZENICH, Andreas BALDEWEIN, Bernd HOWALD, and Volker HEINS

It is certified that error appears in the above-identified patent and that said Letters Patent is hereby corrected as shown below:

In column 1, line 14, after the first occurrence of 'by' insert --means--.

In column 1, line 54, after 'or', delete "star" and insert --similar--.

In column 2, line 4, after 'short,', delete "dire" and insert --direct--.

In column 2, line 5, after 'devices', delete "fo" and insert --of--.

In column 2, line 6, after 'breaker', delete "meachanism" and insert --mechanism--.

UNITED STATES PATENT AND TRADEMARK OFFICE

CERTIFICATE OF CORRECTION

PATENT NO. : 5,774,031

DATED : June 30, 1998

INVENTOR(S) : Uwe LINZENICH, Andreas BALDEWEIN, Bernd HOWALD, and Volker HEINS

It is certified that error appears in the above-identified patent and that said Letters Patent is hereby corrected as shown below:

In column 4, line 15, after the second occurrence of 'the', delete "tripe" and insert --tripped--.

In column 4, line 63, after 'relatively', delete "s" and insert --small--.

In column 6, line 10, Claim 10, after 'area' insert --of--.

Signed and Sealed this

Thirtieth Day of March, 1999

Q. Todd Dickinson

Q. TODD DICKINSON

*Acting Commissioner of Patents and Trademarks*

*Attest:*

*Attesting Officer*